United States Patent [19]

Klema

[11] 4,192,100

[45] Mar. 11, 1980

[54] SLIDING DOOR APPARATUS

[76] Inventor: Kenneth G. Klema, 2209 - 4½ Mile Rd., Racine, Wis. 53402

[21] Appl. No.: 853,552

[22] Filed: Nov. 21, 1977

[51] Int. Cl.[2] ..... E05D 15/26; E05D 15/06

[52] U.S. Cl. ..... 49/404; 49/125; 49/425; 49/478

[58] Field of Search ..... 49/125, 478, 425, 412, 49/409, 410, 411, 404

[56] References Cited

U.S. PATENT DOCUMENTS

| | | | |
|---|---|---|---|
| 2,627,097 | 2/1953 | Ellis | 49/478 X |
| 2,628,588 | 12/1971 | Dixon | 49/412 X |
| 3,120,683 | 2/1964 | Harris | 49/125 |
| 3,156,020 | 11/1964 | Horgan, Jr. | 49/409 |
| 3,460,290 | 8/1969 | Wutzke | 49/425 X |
| 3,469,349 | 9/1969 | Multer | 49/478 |
| 3,628,289 | 12/1971 | Buffington et al. | 49/409 |

*Primary Examiner*—Philip C. Kannan
*Attorney, Agent, or Firm*—Peter N. Jansson

[57] ABSTRACT

Sliding door apparatus for closing large openings in large building structures. The invention is characterized by a sliding door engaged with a building structure and having at least one edge aligned to slide parallel to a portion of the door frame, the edge and frame portion defining a gap therebetween and constituting two relatively moveable adjacent members one of which has a magnetically receptive surface extending along the gap, the other having a flexible magnetic sealing strip along the gap and spanning the gap to magnetically engage the surface when the sliding door is closed.

12 Claims, 6 Drawing Figures

SLIDING DOOR APPARATUS

BACKGROUND OF THE INVENTION

This invention relates to sliding door apparatus and in particular to an improved sealing arrangement for sliding doors of the type used in closing large openings in large building structures.

Unique problems are associated with sliding doors of the type used in closing large openings in large building structures such as airplane hangars, factories and warehouses. Of primary interest is the difficulty in obtaining a suitably sealed closure with doors of such large dimension. Sliding doors of various kinds are the most practical means to removably cover large openings such as in hangars. However, large sliding doors present unusual and difficult problems in attempting to provide suitable sealing engagement of door to door frame.

In order to facilitate the sliding movements of such doors, it is necessary to build in adequate clearance between the door and the door frame. Furthermore, large building structures, such as hangars are quite often structures of a type prone to react significantly to environmental changes and conditions, including those involving temperature, wind, and roof snow loads. With such conditions, the problems associated with obtaining suitably sealed closures therewith are exacerbated. The thermal expansion and contraction, the bowing and bending, and the like, often necessitate greater clearance between the door frame and the sliding door, which in turn brings sealing problems of a different sort.

Various seals have been designed for such sliding doors, including seals made of conventional rubber and other similar sealing materials. Such seals typically are designed to provide an optimum seal by a dimension-critical interference fit. However, experience has shown that such seals lead to leakage because of their inability to conform to changing building conditions, such as those caused by wind, temperature, and snow loads. Moreover, the tendency of such seals to take a particular set upon aging reduces their ability to conform and to form a consistently good interference seal between the sliding door and the frame. Such disadvantages are apparent even with specific designs made to optimize the usefulness of such seals for changing building conditions.

SUMMARY OF THE INVENTION

The invention disclosed and claimed herein is intended to overcome these problems and to provide a satisfactory long-lasting sliding door sealing apparatus useful in closing large openings in large building structures such as hangars, factories and warehouses. The sliding door apparatus of this invention includes a frame and at least one sliding door engaged with a building structure and having at least one edge aligned parallel to a portion of the frame and spaced therefrom by a clearance gap. The edge and frame constitute relatively movable adjacent members one of which has a magnetically receptive surface extending along the gap and the other of which has a flexible magnetic sealing strip attached along the gap and spanning the gap to magnetically engage the magnetically receptive surface when the door is closed. In some embodiments the receptive surface is on the door edge and the flexible magnetic sealing strip is on the frame. In other embodiments the flexible magnetic sealing strip is on the door edge and the magnetically receptive surface is on the frame.

In a preferred embodiment, the receptive surface and the magnetic strip are convergent at one set of their adjacent ends to substantially intersect when the door is substantially closed. Upon such intersection during closing, a magnetic wave action is initiated in the strip which continues until the seal effectively closes the gap along the entire length of the sliding door.

OBJECTS OF THE INVENTION

A principal object of this invention is to provide a sliding door apparatus for use in closing large openings in large building structures such as airplane hangars.

Another object of this invention is to provide a unique sliding door apparatus having superior weathertight sealing ability.

Yet another object of this invention is to provide a sealing arrangement for sliding doors of the type used in large structures which can conform to changing conditions in such structures.

Another object of this invention is to provide a sliding door sealing apparatus which has superior performance characteristics over a long period of time.

These and other objects of the invention will be apparent from the description of preferred embodiments which follows and from the drawings.

DETAILED DESCRIPTIONS OF PREFERRED EMBODIMENTS

Like numerals are used throughout the drawings to designate like parts in the preferred embodiments illustrated.

Figure 1:
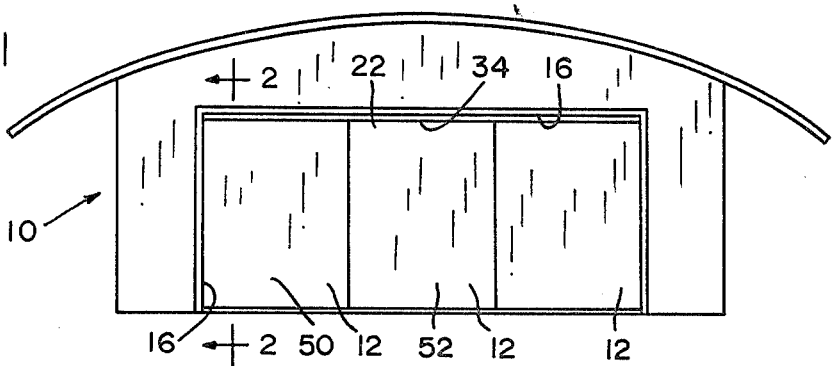
FIG. 1 is a front elevation of a large building structure such as a hangar having multiple sliding doors.

FIG. 1 illustrates a large building 10 such as an airplane hangar having sliding doors 12 for removably covering a large access opening. Doors 12 are arranged on building 10 to close by sliding to their rightmost position as shown in FIG. 1. FIG. 1 shows doors 12 in the fully closed position. To open, each of doors 12 would slide to the left as shown in FIG. 1. The doors slide in closely aligned parallel planes. When the access opening, which is defined by the door frame 16 of building 10, is open, the three doors 12 are fully overlapped and moved partially away from the opening, partially to the left thereof.

Figure 2:
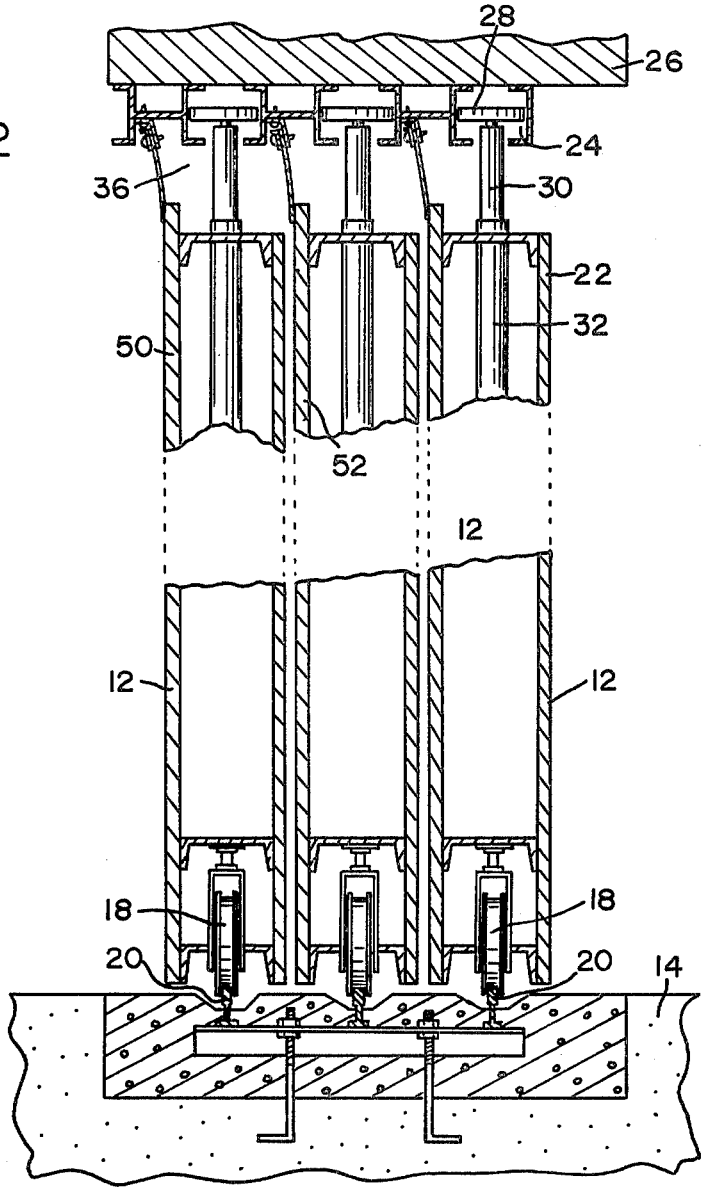
FIG. 2 is an enlarged, partial side sectional view, as indicated by section 2—2 in FIG. 1, showing the sliding door apparatus, with the three doors moved to the open (left FIG. 1) position, however, unlike the closed position shown in FIG. 1.
Figure 3:
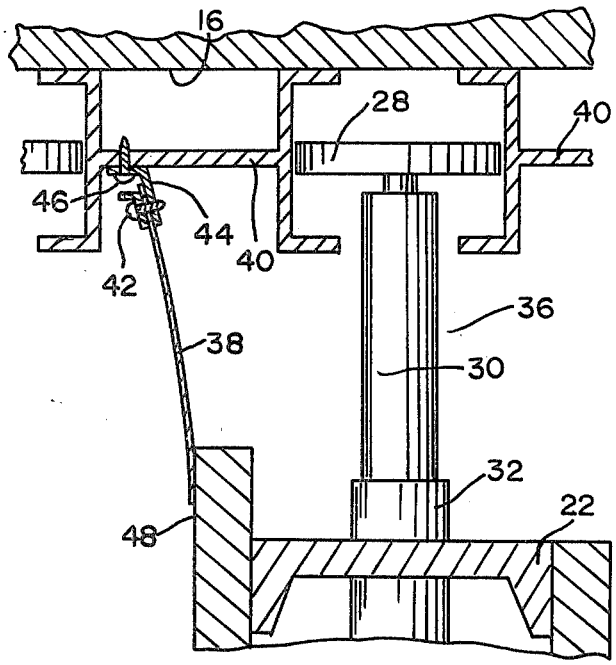
FIG. 3 is an enlarged fragmentary view of the top portion of one sliding door apparatus of FIG. 2.

FIGS. 2 and 3 illustrate the structure, mounting and operation of sliding doors 12. Each door 12 includes rollers 18 near the floor 14. Each door 12 is engaged with a track 20 through its rollers 18. Track 20 for each door is permanently mounted in concrete floor 14 of building 10 along the line of which the doors are intended to be moved. The upper edge 22 on each door is maintained in generally the proper line and in alignment with track 20 by means of an alignment slot 24 secured to the door header 26. Header 26, alignment slots 24 and the structural spacing members 40 which join slot members 24 form the upper edge of frame 16. The doors 12 each have at least two slot follower wheels 28 within slots 24 to guide the doors during sliding movement. Each slot follower wheel 28 is journaled on a height adjustment rod 30 which is free to slide in a rod guide 32 secured to the door. Height adjustment rods 30 and their associated apparatus prevent doors 12 from binding as they slide across the access opening, which could readily occur with the slightest variation in dimensions.

Upper edge 22 of each door 12 is aligned substantially parallel with upper portion 34 of frame 16. A gap 36 is defined between upper portion 34 of frame 16 and upper edge 22 of each door 12. A substantial gap 36 is highly preferred in sliding door structures to accomodate the aforementioned dimensional changes which can occur for a number of reasons, including temperature variations, snow loads, changing wind conditions and the like.

Gap 36 between each door 12 and its adjacent frame portion 34 is sealed by flexible magnetic sealing strip 38. As illustrated best in FIGS. 2 and 3, strips 38 are secured to upper frame portion 34, and, more specifically, to structural members 40. Each strip 38 is attached by fasteners 42 to a rigid mounting strip 44 extending along frame 16 parallel to upper edge 22 of door 12. Mounting strips 44 are attached to frame 16 by means of fasteners 46, as shown in FIG. 3. Mounting strips 44 are set at an angle with respect to frame 16 and door 12 to direct flexible magnetic sealing strips 38 toward upper edges 22 of doors 12.

Upper edges 22 of doors 12 include magnetically receptive surfaces 48, each extending along upper edge 22 in the plane of the surface of door 12. Each magnetically receptive surface 48 is preferably steel or some other material which is magnetically attracted. When a door 12 is in its closed position, its upper edge 22 is in a position adjacent the length of flexible magnetic sealing strip 38. By virtue of the magnetic attraction between strips 38 and magnetically receptive surfaces 48 of doors 12, the flexible magnetic sealing strips span gap 36 along upper edges 22 and magnetically engage receptive surfaces 48 to complete the closure of the door opening in substantialy weather-tight fashion.

By virtue of its magnetic properties, the flexible magnetic sealing strip is far less prone to assume a particular set on aging which would prevent it from functioning in the desired fashion to close gap 36. Stated differently, the arrangement of this invention is such that the sealing strip will function adequately over a much broader range of varying door conditions than was possible with prior art sliding door seals.

Figure 4:
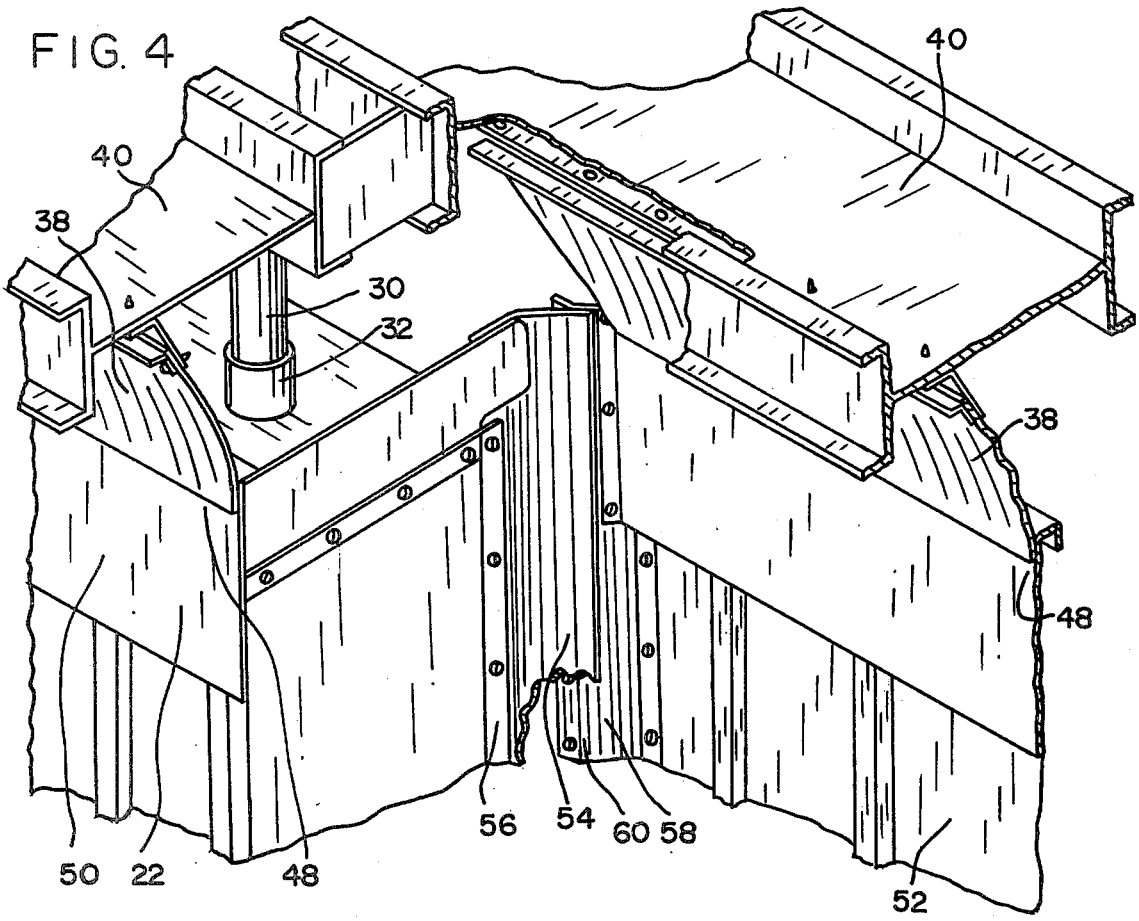
FIG. 4 is an enlarged, fragmentary perspective view of two adjacent sliding doors illustrating one form of the sealing apparatus of this invention.

FIG. 4 illustrates the details of a preferred sealing arrangement which may be used along the vertical (in the embodiments illustrated) juncture of two adjacent sliding doors. First door 50, the corner of which is shown in FIG. 4, was the first of the two illustrated doors to reach its fully closed position by moving to the right as shown in FIG. 4. Flexible magnetic sealing strip 38 is fully engaged with receptive surface 48 and has closed gap 36 between first door 50 and frame 16. Second door 52 next slides to the right, to the position shown in FIG. 4, and is sealed in the same fashion along its upper edge 22. A non-magnetic, vertical, interference seal strip 54 attached to the leading side edge 56 of first door 50 of necessity mechanically interferes with vertical sealing surface 58 which is formed on the trailing side edge 60 of the second door 52. The seal is completed by a further flexible seal piece not shown which can join each of the ends of the two flexible magnetic sealing strips illustrated in FIG. 4 to complete the closure of gap 36.

Figure 5:
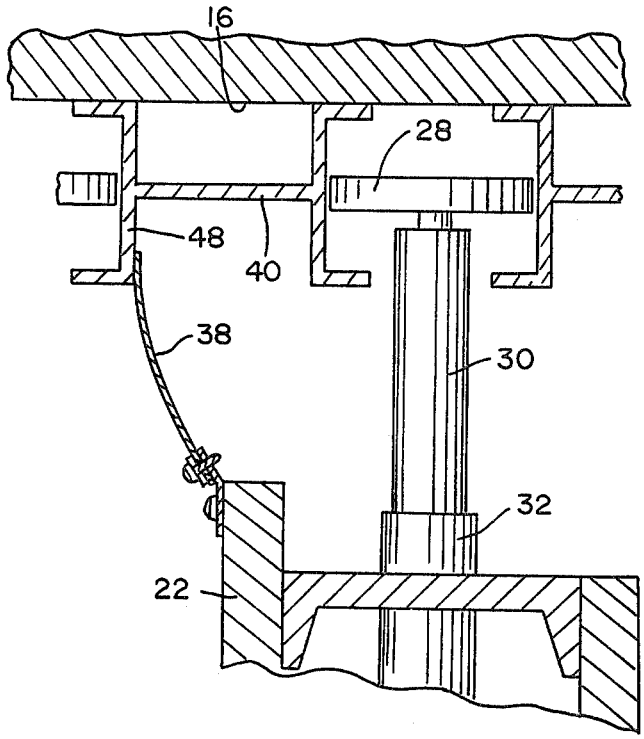
FIG. 5 is an enlarged, fragmentary perspective view similar to FIG. 4 but showing an alternate embodiment of this invention.

The upper edges of the sliding doors illustrated in the drawings and the frame portions substantially parallel thereto constitute relatively moveable adjacent members. In the embodiment illustrated in FIGS. 2–4, flexible magnetic sealing strip 38 was attached to the frame portion adjacent to the sliding door upper edge parallel thereto. FIG. 5 illustrates an alternate embodiment in which flexible magnetic sealing strip 38 is attached to upper edge 22 of sliding door 12, and the magnetically receptive surface 48 is formed on frame 16, the reverse of the previously described embodiment. The seal functions in substantially the same manner in the embodiment of FIG. 5 as in the embodiment previously described.

Figure 6:
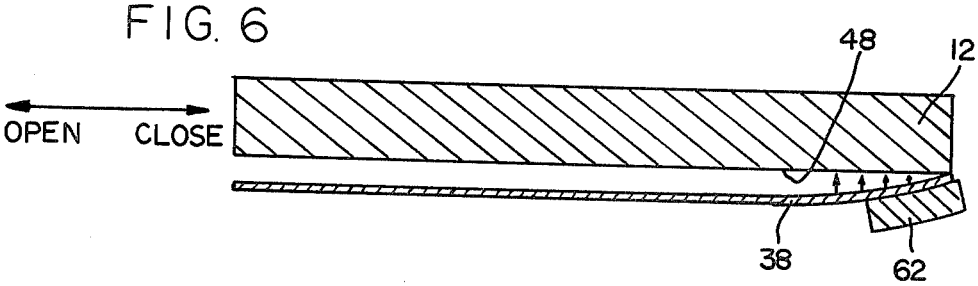
FIG. 6 is a schematic drawing illustrating a preferred embodiment of this invention.

FIG. 6 schematically illustrates a preferred embodiment of this invention. Receptive surface 48 of upper edge 22 of door 12 and flexible magnetic sealing strip 38 are made convergent at one set of their adjacent ends to intersect when door 12 is substantially closed, as illustrated in FIG. 6. As door 12 moves to the closed position as shown in FIG. 6, its receptive surface intersects one end of strip 38, initiating a magnetic wave action of strip 38 along magnetically receptive surface 48 to effectively and positively close the gap therebetween.

The convergence illustrated in FIG. 6 is obtained by means of a deflector piece 62 which permanently keeps one end of strip 38 in an intersecting orientation with respect to door 12. Such convergence may be obtained in a number of other ways, depending on the precise seal arrangement used. For example, in the embodiment of FIG. 5 the magnetically receptive surface 48 could be bent at one end thereof such that one end of the sliding magnetic sealing strip 38 would of necessity intersect receptive surface 48 when door 12 reaches its closed position.

The flexible magnetic sealing strip may gain its magnetic properties in any of a number of ways. For example, magnetic bars or pieces of other shape may be joined to or formed in the flexible strip material in a number of ways. Attachment along the free edge of the strip in a manner preserving the sealing properties of the strip is preferable. Many suitable means would be apparent to those skilled in the art who are familiar with this invention.

In a highly preferred embodiment, which is illustrated in the drawings, flexible magnetic sealing strip 38 may be formed of natural or synthetic materials, such as rubber, vinyl and a wide variety of other known flexible materials, having a multiplicity of magnetized ferrite particles interspersed and trapped within the matter in like magnetic orientation. A preferred material for strip 38 is a flexible, permanent magnetic sheet material sold under the trademark PLASTIFORM by 3M Company. The PLASTIFORM material is a vinyl having barium ferrite ferromagnetic crystals therein. Other suitable materials are available from Goodrich Tire and Rubber Company and other suppliers. In one embodiment of this invention, the strip is formed of a rubber-like curtain of flexible material having a magnetic edge formed of the same or another material having a multiplicity of magnetic particles interspersed therein. Acceptable variations would be apparent to those skilled in the art to whom this invention has been disclosed.

Various materials useful for the several components of this invention will be apparent to those skilled in the art to whom this invention has been disclosed. Structural steel members and sheet metal members are highly preferred, although other materials would, of course, be acceptable, depending on the requirements for a particular embodiment.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. Sliding door apparatus for closing an opening in a building structure, comprising:

a frame on said structure defining said opening;

at least one sliding door engaged with said structure and having an edge aligned substantially parallel to a portion of said frame, said edge and said frame portion constituting relatively moveable, adjacent members defining a gap therebetween;

rods extending from one of said adjacent members, spanning said gap, and terminating in distal ends engaged in guides on the other of said adjacent members, said rods being axially slidable with respect to at least one of said adjacent members to accommodate changing gap dimensions while engaging said guides;

a magnetically receptive surface on one of said adjacent members and extending along said gap;

a flexible sealing strip attached to the other of said adjacent members along said gap and spanning said gap and having magnetic means therewith to magnetically engage said strip with said receptive surface when said door is closed;

means causing convergence of said receptive surface and said strip at one set of their adjacent ends when said door is substantially closed thereby to initiate a magnetic wave action to close said gap in substantially weather-tight fashion.

2. The apparatus of claim 1 wherein said magnetic means comprises a multiplicity of magnetized particles interspersed and trapped in said flexible sealing strip.

3. The apparatus of claim 1 wherein said receptive surface is on said edge and said strip is attached to said frame portion.

4. The apparatus of claim 3 wherein said magnetic means comprises a multiplicity of magnetized particles interspersed and trapped in said flexible sealing strip.

5. The apparatus of claim 1 wherein said strip is attached to said edge and said receptive surface is on said frame portion.

6. The apparatus of claim 4 wherein said magnetic means comprises a multiplicity of magnetized particles interspersed and trapped in said flexible sealing strip.

7. Sliding door apparatus for closing an opening in a building structure, comprising;

a frame on said structure defining said opening;

at least one sliding door engaged with said structure and having an edge aligned substantially parallel to a portion of said frame, said edge and said frame portion constituting relatively moveable, adjacent members defining a gap therebetween;

a magnetically receptive surface on one of said adjacent members and extending along said gap; and a flexible sealing strip attached to the other of said adjacent members along said gap and spanning said gap and having magnetic means therewith to magnetically engage said strip with said receptive surface when said door is closed, said receptive surface and said strip being convergent at one set of their adjacent ends to intersect when said door is substantially closed, thereby initiating a magnetic wave action of said strip to close said gap in substantially weather-tight fashion.

8. The apparatus of claim 7 wherein said magnetic means comprises a multiplicity of magnetized particles interspersed and trapped in said flexible sealing strip.

9. Sliding door apparatus for closing an opening in a building structure, comprising:

a frame on said structure defining the opening;

at least one sliding door engaged with said structure and having an edge aligned with a portion of the frame, the edge and frame portion constituting relatively moveable adjacent members defining a gap therebetween;

a magnetically receptive surface on one of the adjacent members and extending along the gap;

a sealing strip attached to the other adjacent member along the gap and having magnetic means therewith to engage the strip to the receptive surface when the door is closed; and means to cause convergence of the strip and receptive surface at one set of their adjacent ends when the door is substantially closed thereby to initiate sealing of the gap.

10. The apparatus of claim 9 wherein the receptive surface is on the door edge and the strip is attached to said frame portion.

11. The apparatus of claim 10 wherein the strip is a flexible material having a multiplicity of magnetized particles interspersed and trapped therein.

12. The apparatus of claim 11 wherein the receptive surface is on the door edge and the strip is attached to said frame portion.

* * * * *